US011661698B2

(12) United States Patent
Hildebrand

(10) Patent No.: US 11,661,698 B2
(45) Date of Patent: May 30, 2023

(54) PRESSING MEMBRANE AND A DEVICE HAVING SUCH A PRESSING MEMBRANE FOR DEWATERING LAUNDRY

(71) Applicant: Herbert Kannegiesser GmbH, Vlotho (DE)

(72) Inventor: Jürgen Hildebrand, Hildesheim (DE)

(73) Assignee: Herbert Kannegiesser GmbH, Vlotho (DE)

( * ) Notice: Subject to any disclaimer, the term of this patent is extended or adjusted under 35 U.S.C. 154(b) by 264 days.

(21) Appl. No.: 17/151,959

(22) Filed: Jan. 19, 2021

(65) Prior Publication Data

US 2021/0222349 A1 Jul. 22, 2021

(30) Foreign Application Priority Data

Jan. 21, 2020 (DE) ..... 202020000223.2

(51) Int. Cl.
*D06F 47/04* (2006.01)
*D06F 47/06* (2006.01)
*D06F 47/08* (2006.01)

(52) U.S. Cl.
CPC ..... *D06F 47/06* (2013.01); *D06F 47/04* (2013.01); *D06F 47/08* (2013.01)

(58) Field of Classification Search
USPC ..... 68/21
See application file for complete search history.

(56) References Cited

U.S. PATENT DOCUMENTS

2010/0313440 A1* 12/2010 Poy ..... D06F 47/06 34/143

FOREIGN PATENT DOCUMENTS

| | | | |
|---|---|---|---|
| DE | 102014211460 | A1 | 12/2015 |
| DE | 202019002021 | U1 | 7/2019 |
| EP | 0310842 | B1 | 4/1984 |
| EP | 1388605 | A2 | 2/2004 |

OTHER PUBLICATIONS

Deutsches Patent—Und Markenamt (German Patent and Trademark Office), Europaischer Recherchenbericht (search in a related application, May 21, 2021.

Deutsches Patent—Und Markenamt (German Patent and Trademark Office), Recherchebericht (search in a related application, Sep. 22, 2020.

* cited by examiner

*Primary Examiner* — Levon J Shahinian
(74) *Attorney, Agent, or Firm* — Laurence P. Colton; Smith Tempel Blaha LLC

(57) ABSTRACT

Devices for dewatering washed laundry have a pressing membrane. The pressing membrane is releasably fastened below a ram plate of the device by way of a fastening ring. This connection is very complex by virtue of the heavy weight of the pressing membrane which has a diameter of approximately 1 m. In order for the fastening of the pressing membrane by way of the fastening ring below the ram plate to be facilitated, it is provided that the pressing membrane on the membrane collar thereof has at least one internal-side protrusion which while assembling the pressing membrane below the ram plate forms a bearing for the fastening ring. On account thereof, the fastening ring is temporarily supported below the ram plate while assembling the pressing membrane, this permitting easier assembling of the pressing membrane below the ram plate.

16 Claims, 3 Drawing Sheets

PRESSING MEMBRANE AND A DEVICE HAVING SUCH A PRESSING MEMBRANE FOR DEWATERING LAUNDRY

CROSS REFERENCE TO RELATED APPLICATIONS

This patent application claims priority on and the benefit of German Patent Application No. 20 2020 000 223.2 having a filing date of 21 Jan. 2020.

BACKGROUND OF THE INVENTION

Technical Field

The invention relates to a pressing membrane for a device for dewatering laundry, having a membrane base and a membrane collar which is molded on the latter and has an encircling upper periphery and a peripheral region which for releasably fastening the membrane collar by means of a fastening ring below a ram plate of a press ram emanates from said upper periphery, said ram plate being able to be moved up and down, as well as to a device for dewatering laundry having a pressing membrane that is releasably fastenable below a ram plate by way of a fastening ring, and a press ram being able to be moved up and down, and the pressing membrane having a membrane base and a membrane collar which is molded on the latter and has an encircling upper periphery.

Prior Art

Devices provided with pressing membranes for dewatering laundry, so-called dewatering presses, are used in commercial laundries for dewatering laundry of all types. To this end, liquids are largely squeezed out of washed laundry by the device having the pressing membrane. The device can optionally also serve for rinsing washed laundry.

A device of the type discussed here having a pressing membrane is known from EP 0 310 842 B1. This device possesses a press ram which is able to be moved up and down by a hydraulic cylinder. The press ram possesses a ram plate below which the pressing membrane is releasably fastened. The washed laundry is dewatered in a pressing basket of the device that is disposed below the press ram. When the press ram moves down in the manner performed by the hydraulic cylinder, the pressing membrane fastened therebelow compresses the laundry in the pressing basket, wherein the pressing membrane that is formed from an elastically deformable material adapts flexibly to the laundry in the pressing basket.

The fastening of the pressing membrane below the ram plate of the press ram is disadvantageous in the known device. This fastening takes place by way of a fastening ring which is also referred to as an "assembly ring" and by way of which the pressing membrane is tightly screw-fitted below the ram plate. To this end, the fastening ring has in particular to be precisely positioned by technicians and held below the raised ram plate so that the fastening ring can be preassembled with screws below said ram plate. As a consequence of the large diameters of pressing membranes being approximately one meter and optionally even more, the fastening rings are very heavy and therefore difficult to handle by the technicians.

BRIEF SUMMARY OF THE INVENTION

The invention is based on the object of achieving a device for dewatering laundry and a pressing membrane provided therefor, wherein the pressing membrane by way of a fastening ring can be easily fastened below the ram plate of the device without any large effort in terms of force by the technicians.

A pressing membrane for achieving this object is a pressing membrane for a device for dewatering laundry, having a membrane base and a membrane collar which is molded on the latter and has an encircling upper periphery and a peripheral region which for releasably fastening the membrane collar by means of a fastening ring below a ram plate of a press ram emanates from said upper periphery, said ram plate being able to be moved up and down, wherein the membrane collar on the internal side thereof has at least one protrusion for forming an at least temporary bearing for the fastening ring until connecting the pressing membrane to the ram plate. This pressing membrane which has a lower membrane base and a membrane collar molded on said pressing membrane above the membrane base is provided with at least one protrusion that projects in relation to the internal wall of the membrane collar. The at least one protrusion is situated below an upper free periphery of the membrane collar that surrounds an upper opening across the full area of the pressing membrane. On account thereof, the fastening ring is able to be introduced and/or inserted into the membrane collar from above and is thereafter at least temporarily supported on the at least one protrusion. It suffices for the fastening ring to be supported on the at least one protrusion only until the fastening ring, preferably with screws, is connected to the lower side of the press ram, in particular the ram plate thereof, because the presence of any support of the fastening ring on the at least one protrusion of the membrane collar is required only until the fastening ring is initially connected to the ram plate.

As a consequence of the at least one protrusion in the interior of the membrane collar, the fastening ring does no longer have to be held after being inserted into the membrane collar. The at least one protrusion then holds the fastening ring in the region of the upper periphery of the membrane collar of the pressing membrane. The ram plate of the press cylinder can then be moved down onto the upper periphery of the pressing membrane and the fastening ring inserted in the latter until the connection between the fastening ring and the ram plate can be established, in particular with screws. The connection of the pressing membrane to the fastening ring below the ram plate can be performed without the fastening ring and/or the pressing membrane to this end having to be held below the ram plate by technicians, and without any permanent connection between the fastening ring and the pressing membrane which would necessitate that the fastening ring is also replaced when a pressing membrane is replaced.

The at least one protrusion is preferably configured such that said protrusion protrudes into an interior space of the membrane collar that is surrounded by the latter, in particular in the direction of a vertical longitudinal central axis of the membrane collar projects radially in relation to the inner wall of the membrane collar. On account thereof, the interior space of the membrane collar is constricted below the upper periphery of the latter and/or at least one step is formed here in the pressing membrane by the at least one protrusion, the fastening ring being able to be supported on said step at least until being initially connected to the lower side of the ram plate of the press ram.

The at least one protrusion preferably protrudes into an interior space of the pressing membrane that is surrounded by the membrane collar. The at least one protrusion in the direction of a vertical longitudinal central axis of the membrane collar and/or of the pressing membrane herein protrudes in particular radially into the interior space. The fastening ring is able to be supported on at least one such protrusion until being connected to the ram plate without slipping completely into the pressing membrane.

In one advantageous design embodiment of the pressing membrane the at least one protrusion forms an upper bearing face of the single protrusion or of the respective protrusion in the interior of the membrane collar. This bearing face of the single protrusion or the bearing face of all protrusions preferably lies/lie in a plane which orthogonally intersects the longitudinal central axis of the pressing membrane and/or of the membrane collar thereof. On account thereof, the fastening ring that is supported on the at least one bearing face is held in the plane of the upper periphery of the membrane collar or so as to be just below the latter, wherein this plane runs so as to be parallel to the plane of the ram plate, on account of which the fastening ring in the upper end region of the membrane collar for easy connecting to the ram plate is held in an exact alignment at least until the connection of the fastening ring below the ram plate has been established.

According to one advantageous potential design embodiment of the pressing membrane, the at least one protrusion is disposed so far below the upper periphery of the membrane collar that the bearing face of the protrusion or the bearing faces of a plurality of protrusions is/are situated at a spacing below the upper periphery of the membrane collar, wherein this spacing preferably corresponds to at least the height of the fastening ring. On account thereof, the fastening ring is offered up in the upper end region of the pressing membrane or of the membrane collar of the latter, respectively, such that the ram plate can be lowered tightly onto the fastening ring or down to the fastening ring so as to subsequently be able to establish the connection, in particular the screw connection, between the ram plate and the fastening ring.

It can be provided that the at least one protrusion of the membrane collar is disposed on the lower end of an upper peripheral portion of the membrane collar and/or the at least one protrusion delimits a lower end of the peripheral portion of the membrane collar. On account thereof, the insertion depth of the fastening ring into the pressing membrane, in particular the membrane collar of the latter, is established by the at least one protrusion. This penetration depth is preferably chosen such that the upper ring face of the fastening ring coincides with the plane of the upper periphery of the membrane collar or lies slightly below the latter. On account thereof, the fastening ring is exactly aligned and held in position by the pressing membrane for connecting the fastening ring to the ram plate.

It is preferably provided that a single encircling protrusion is provided in the membrane collar so as to be below the plane of the periphery of the latter. This protrusion thus represents an encircling constriction in the membrane collar of the pressing membrane and thus forms an annular encircling bearing face for the lower side of the fastening ring that is to be inserted from above into the pressing membrane. Alternatively however, a plurality of separate protrusions can also be provided within the pressing membrane so as to be spaced apart from the upper periphery of the membrane collar. Each of these protrusions has a bearing face for the lower side of the fastening ring. The bearing faces of all of the protrusions herein lie in one common plane which orthogonally intersects the longitudinal central axis of the membrane collar and/or of the pressing membrane. As is likewise the case with one encircling protrusion, this plane in the case of a plurality of protrusions runs so as to be parallel to the plane of the lower side of the ram plate such that the fastening ring on account of the protrusions is aligned so as to be parallel to the ram plate, and that a connection between the fastening ring and the ram plate which can in particular be established with screws is able to be established in a simple manner without any kind of additional alignment measures on account thereof.

In one advantageous potential design embodiment of the pressing membrane it is provided that the membrane collar thereof tapers toward the periphery. Alternatively or additionally, it can be provided that an external side of the membrane collar at least in the upper peripheral region tapers toward the upper free periphery. On account thereof, an elastic preload of the upper peripheral region of the membrane collar between a correspondingly annular outer collar below the ram plate can be obtained when tightening the screws of the fastening ring below the ram plate. An at least clamping connection between the pressing membrane and the ram plate takes place on account thereof.

A device for achieving the object mentioned at the outset is a device for dewatering laundry, having a press ram which has a ram plate and a flexible pressing membrane that is releasably fastenable below said ram plate by way of a fastening ring, said press ram being able to be moved up and down, and the pressing membrane having a membrane base and a membrane collar which is molded on the latter and has an encircling upper periphery, wherein the membrane collar on the internal side thereof has at least one protrusion which is configured as a bearing for the fastening ring at least until connecting said fastening ring to the ram plate. Accordingly, the membrane collar on the internal side thereof possesses at least one protrusion. The at least one protrusion serves as a temporary bearing for the fastening ring.

The bearing is maintained at least until the connection between the fastening ring and the ram plate has been established. On account thereof, the fastening ring is insertable from above into the pressing membrane, specifically only so far until said fastening ring is stopped by the at least one bearing of the membrane collar. The fastening ring is preferably thus held in the upper end region or peripheral region, respectively, of the membrane collar. After the fastening ring has been inserted into the upper end region of the membrane collar, the ram plate of the device can then be lowered completely onto the upper side of the fastening ring, or to just short of the latter, so that an at least initial and/or partial connection between the fastening ring and the ram plate can be established. Therefore, there is no longer any need for the fastening ring to be separately handled after having been inserted into the upper end region or peripheral region, respectively, of the membrane collar of the pressing membrane. Rather, said fastening ring conjointly with the pressing membrane rests on a support pad of the device such that only the ram plate has to be moved down in order for the fastening ring, and conjointly therewith, the pressing membrane to be able to be connected to the ram plate.

The at least one protrusion preferably forms a bearing for the fastening ring at least for initially connecting the fastening ring to a lower side of the ram plate. The lower side of the fastening ring in the upper end region of the membrane collar is then supported on this at least one bearing until said fastening ring is connected to the ram plate but not yet finally fastened therebelow.

According to one preferred design embodiment of the device it is provided that the fastening ring on the external wall thereof has a profiled structure, in particular an encircling protrusion in the lower end region and/or an encircling constriction preferably above the protrusion. Alternatively or additionally, it can be provided that the upper peripheral region of the membrane collar, between the upper periphery thereof and the bearing face of the at least one protrusion in the membrane collar, is provided with an internal-side profiled structure. When the fastening ring also has an external profiled structure these two profiled structures are configured such that the latter at least approximately correspond to each other. On account thereof, a form-fitting connection and/or coupling of the fastening ring to the membrane collar of the pressing membrane can be established.

It can furthermore be provided that a lower side of the ram plate is provided with an encircling groove which is preferably situated in the external peripheral region of the ram plate. This groove serves for receiving at least a major part of the fastening ring and of the upper peripheral portion of the membrane collar of the pressing membrane that is assigned to said fastening ring. The encircling groove is of corresponding dimensions. The groove is situated close to the external circumference of the ram plate, wherein the groove on the external side is delimited by an encircling annular collar on the lower side of the ram plate. By way of this groove, the pressing membrane at the upper peripheral region of the membrane collar thereof, conjointly with the fastening ring, can be connected in a form-fitting and/or force-fitting manner to the ram plate, specifically without it being necessary for the fastening ring to this end to be connected to the upper peripheral region of the membrane collar by adhesive bonding and/or vulcanizing. On account thereof, the fastening ring and the pressing membrane are separate parts which can be releasably connected to each other but do not have to be permanently connected to each other.

In the device it is preferably provided that the fastening ring is inserted from above into the pressing membrane, in particular the membrane collar of the latter, specifically so far until the fastening ring bears on the at least one protrusion, in particular the bearing face of said protrusion, and the fastening ring is held in the upper peripheral region of the membrane collar by the at least one bearing such that said fastening ring cannot slip into the pressing membrane and down onto the membrane base.

The pressing membrane of the device described above can advantageously be refined by individual or a plurality of the features of the pressing membrane that have been set forth at the outset.

BRIEF DESCRIPTION OF THE DRAWINGS

Preferred exemplary embodiments of the invention will be explained in more detail hereunder by means of the drawing in which.

DETAILED DESCRIPTION OF PREFERRED EMBODIMENTS

Figure 1:
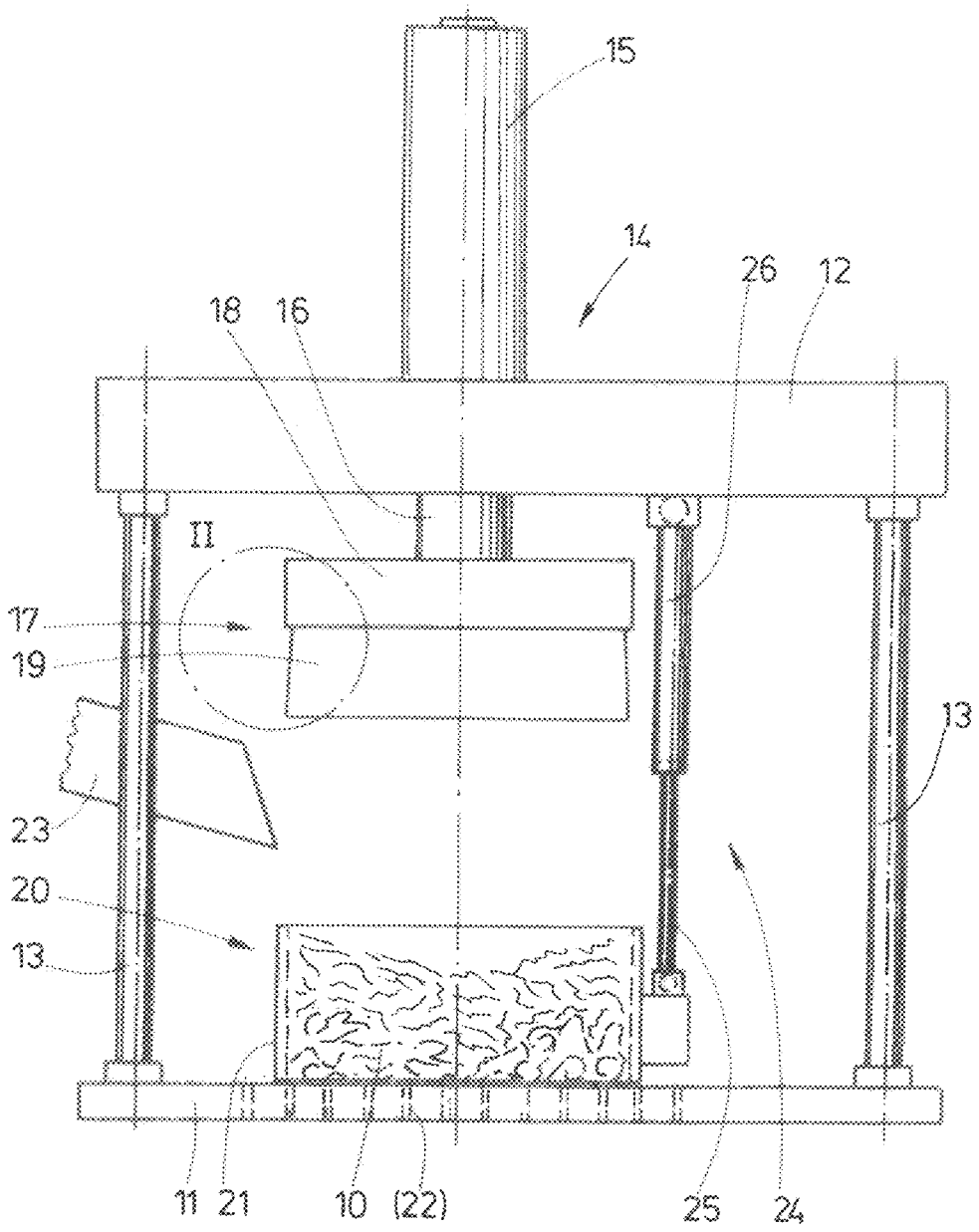
FIG. 1 shows a schematic lateral view of a device for dewatering laundry.

The device shown in the figures is a so-called dewatering press for dewatering laundry 10 of any kind, in particular washed laundry 10. When dewatering, the liquid still contained in the laundry 10, in particular the so-called adsorbed liquor, is largely squeezed out of said laundry 10 by the device. The device can additionally also serve for rinsing the laundry 10 prior to the dewatering.

The device possesses a frame having a partially liquid-permeable base plate 11 which may optionally be assigned a reservoir for collecting the liquid squeezed out of the laundry 10. The frame moreover possesses a press top bar 12 which is disposed at a spacing above the base plate 11. The frame of the device furthermore possesses a plurality of, for example four, upright columns 13 which for rigidly connecting the base plate 11 in a spaced-apart manner to the press top bar 12 are provided between the base plate 11 and the press top bar 12.

A hydraulic cylinder 14 (in terms of the base area) is situated in the center of the press top bar 12. A cylinder body 15 of the hydraulic body 14 is fixedly connected to the press top bar 12 above the latter. A piston rod 16 of the hydraulic cylinder 14 that is able to retract into the cylinder body 15 and be deployed from the latter extends through the press top bar 12 and protrudes downward in relation to the latter.

The device furthermore possesses a press ram 17 having a ram plate 18, and a pressing membrane 19 which is fastened therebelow and is from a flexible, in particular elastically deformable, material, preferably rubber or any other elastomer. A lower end of the piston rod 16 of the hydraulic cylinder 15 is fixedly connected to the ram plate 18 of the press ram 17.

FIG. 1 shows the press ram in the raised initial position in which the piston rod 16 is moved into the cylinder body 15 of the hydraulic cylinder 14.

The device furthermore possesses a pressing basket 20 which is disposed below the press ram 17. The pressing basket 20 is completely open on the upper side and lower side thereof, and to this end is composed of an encircling basket shell 21. In order for the laundry 10 to be loaded and dewatered, the pressing basket 20 by way of the open lower side thereof rests on the base plate 11. The base plate 11 is configured so as to be liquid-permeable, for example by way of a pattern of through bores 22 in the base plate 11, at least in the region of the basket shell 21 of the pressing basket 20.

In the initial position of the device with a raised press ram 17 and a retracted piston rod 16 of the hydraulic cylinder 14 as shown in FIG. 1, an intermediate space is situated between the lower side of the pressing membrane 19 and the open upper side of the pressing basket 20. Said intermediate space serves for loading the pressing basket 20 with laundry to be dewatered and/or to be rinsed. The loading takes place by means of a loading chute 23 which is indicatively illustrated in FIG. 1.

In the device shown, the pressing basket 20 is laterally assigned a small hydraulic cylinder 24. A lower end of a piston rod 25 of the hydraulic cylinder 24 is connected to the pressing basket 20. A cylinder body 26 of the small hydraulic cylinder 24 is fixedly connected to the lower side of the press top bar 12. On account of the smaller hydraulic cylinder 24, the pressing basket 20 can be raised after the dewatering of the laundry 10 so as to discharge from the base plate 11 a laundry block of the compressed and dewatered laundry 10. The pressing basket 20 can optionally also be pivoted about a vertical longitudinal central axis of the smaller hydraulic cylinder 24 such that the space between the press ram 17 and the base plate 13 is vacated.

In the exemplary embodiment of the device illustrated in the figures, the press ram 17, specifically the ram plate 18 as well as the pressing membrane 19 thereof, are of cylindrical configuration. Accordingly, the pressing basket 20 is also cylindrically configured specifically such that the press ram 17, in particular the pressing membrane 19 thereof, can penetrate the pressing basket 20 through the open upper side thereof and herein compress or squeeze, respectively, and dewater and/or rinse the laundry 10.

Figure 2:
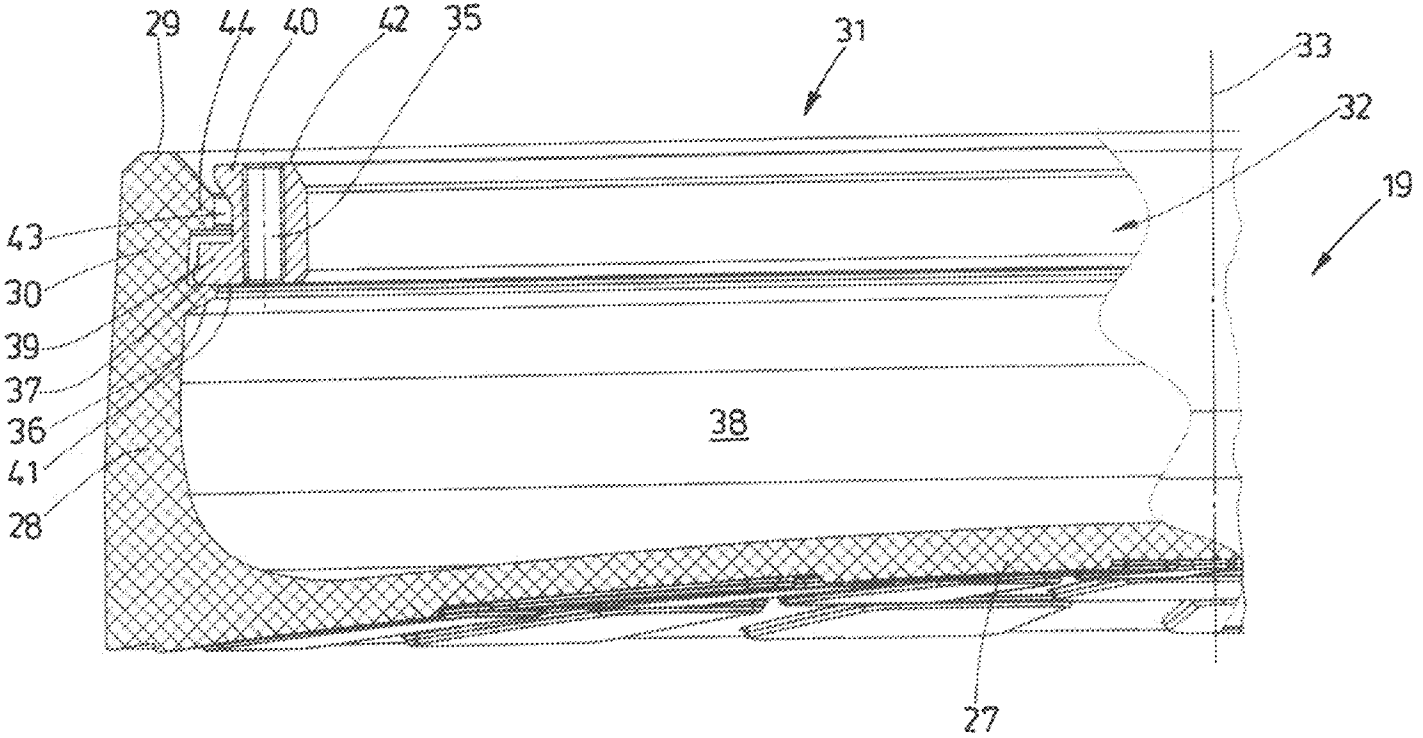
FIG. 2 shows a detail II from FIG. 1 of a pressing membrane having a fastening ring which prior to assembling on a ram plate of the device is supported in the upper peripheral region of said pressing membrane.
Figure 3:
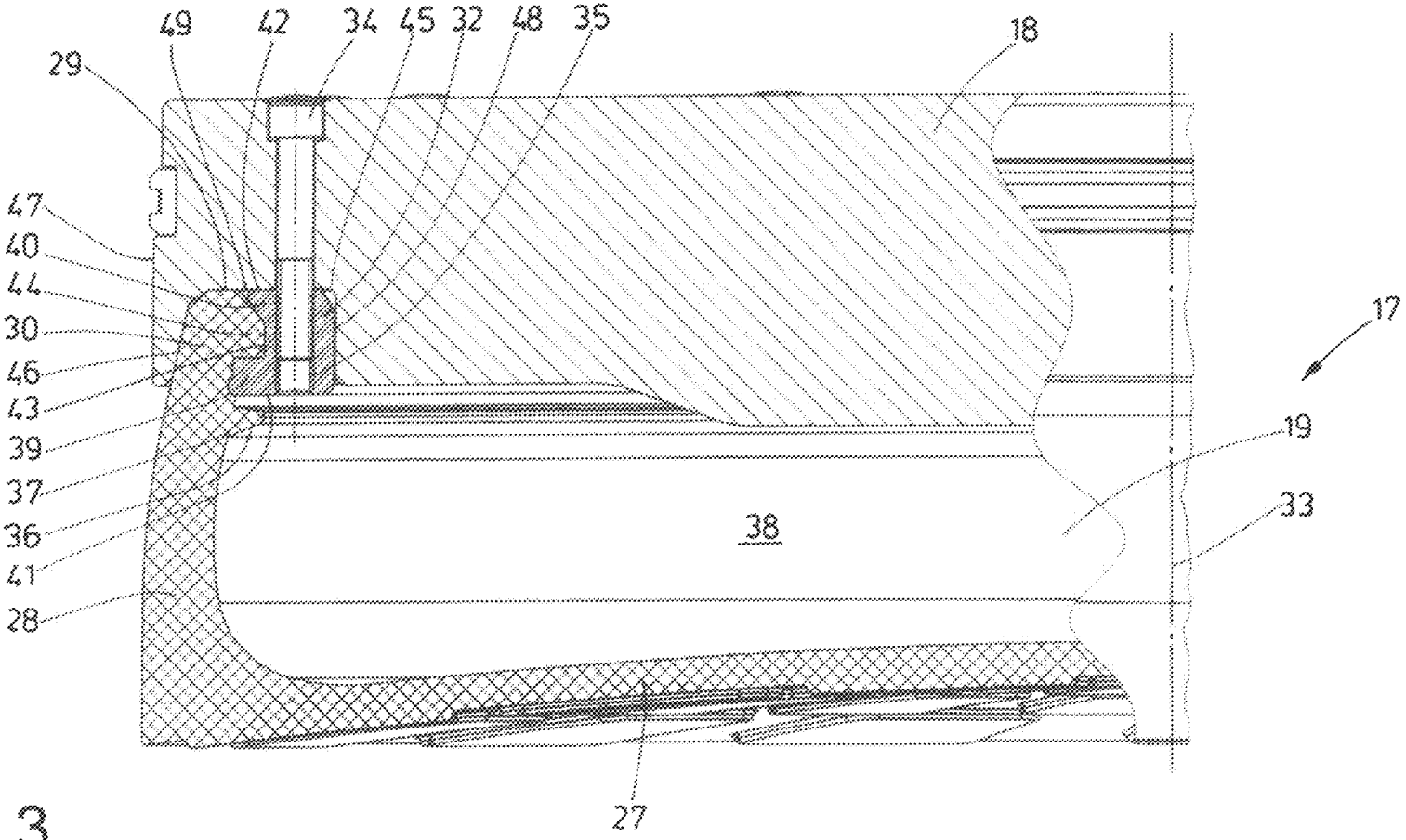
FIG. 3 shows a detail in a manner analogous to that of FIG. 2 with a pressing membrane which is completely fastened below the ram plate by way of the fastening ring.

The pressing membrane 19 in the vertical cross section is configured in the manner of a hat, FIGS. 2 and 3 showing part of said vertical cross section. To this end, the pressing membrane 19 possesses a lower circular membrane base 27 and a tubular or cylindrical, respectively, membrane collar 28 which adjoins the membrane base 27 above the latter. The lower side of the membrane collar 28 is integrally molded to the membrane base 27, specifically such that the external side of the membrane collar 28 terminates flush with the outer periphery of the membrane base 27.

The membrane base 27 in the case of the cylindrical press ram 17 shown here is provided with a circular base area. The membrane collar 28 is configured as an encircling ring or tube, respectively, having a free upper circular periphery 29. An upper peripheral region 30 of the membrane collar 28 that extends in the direction toward the membrane base 27 emanates from the upper free periphery 29 of the membrane collar 28. This peripheral region 30 extends across approximately 20% to 60% of the height of the pressing membrane 19. In the case of the exemplary embodiment shown in the figure, the height of the peripheral region 30 is approximately 40% to 50% of the entire height of the pressing membrane 19. The upper periphery 29 of the membrane collar 28 surrounds the circular upper opening 31 of the pressing membrane 19.

The membrane collar 28 of the pressing membrane 19 by way of the upper peripheral region 30 is releasably connected in particular to the lower side of the dimensionally stable and/or rigid ram plate 18 of a metallic material. This connection between the press ram 17 and the ram plate 18 takes place by means of a fastening ring 32 (in industrial jargon also referred to as an "assembly ring"). The fastening ring 32, like the ram plate, is formed from a rigid, dimensionally stable, metallic material. The fastening ring 32 is able to be released or separated, respectively, from the membrane collar 28 such that said fastening ring 32 does not also have to be replaced when replacing the pressing membrane 19. On account thereof, the fastening ring 32 is reusable.

The fastening ring 32 is dimensioned such that said fastening ring 32 is able to be pushed and/or inserted by way of the upper cylindrical opening 31 of the pressing membrane 19 into the latter. According to the exemplary embodiment of FIG. 2 it may be necessary herein for the upper periphery 29 of the membrane collar 28 to be somewhat elastically expanded. In terms of the height, the fastening ring 32 is dimensioned such that said fastening 32 is somewhat lower than the height or the length, respectively, of the peripheral region 30. The fastening ring 32 can however also have a height which is identical to the height or the length, respectively, of the peripheral region 30.

After the fastening ring 32 has been inserted into the pressing membrane 19 from above, the fastening ring 32 is surrounded by the upper peripheral region 30 of the membrane collar 28. A longitudinal central axis of the fastening ring 32 as well as a longitudinal central axis of the pressing membrane 19 coincide herein in that said longitudinal central axes overlap. This common longitudinal central axis of the fastening ring 32 and of the pressing membrane 19 lies on a longitudinal central axis 33 of the device that runs through the hydraulic cylinder 14 and the basket shell 21 (FIG. 1).

The fastening ring 32 is configured such that said fastening ring 32 can be releasably connected to the ram plate 18. The fastening ring 32 is preferably screw-fitted from below to the ram plate 18 by way of a plurality of screws 34 that are distributed across the circumference of said fastening ring 32, whereupon the latter, just like the pressing membrane 19, is suspended below the ram plate 18. To this end, the fastening ring 32 possesses a plurality of preferably identical thread bores 35 that are correspondingly placed.

A single protrusion 36 which encircles the membrane collar 28 in an annular manner is assigned to the latter at a spacing from the upper periphery 29. The encircling protrusion 36 is preferably placed in the interior of the membrane collar 28 approximately where the peripheral region 33 of the membrane collar 28 that emanates from the upper periphery 29 terminates. Moreover, the spacing of the encircling annular protrusion 36 from the upper periphery 29 of the membrane collar 28 is chosen such that this spacing corresponds to or is somewhat larger than the height of the fastening ring 32 (FIG. 2).

The protrusion 36 in the cross section is configured so as to be wedge-shaped in that said protrusion 36 in the direction toward the longitudinal central axis 33 tapers toward the inward end. An upper delimitation of the protrusion 36 which in the cross section is wedged-shaped herein runs horizontally, whereas a lower delimitation is directed obliquely. The horizontal delimitation of the protrusion 36 lies in a plane which is perpendicularly intersected by the longitudinal central axis 33. The horizontal delimitation or wall, respectively, of the encircling protrusion 36 which in the cross section is wedged-shaped on account thereof forms a flat bearing face 37 on which the lower side of the fastening ring 32 rests, or is supported, respectively, at least prior to being connected to the ram plate 18, on account thereof preventing the fastening ring 32 from dropping into the pressing membrane 19. The encircling protrusion 36 by way of the bearing face 37 thereof moreover also delimits the insertion depth of the fastening 32 into the pressing membrane 19. The fastening ring 32 is thus held by the encircling protrusion 36 of the pressing membrane 19, in particular by the membrane collar 28 thereof, specifically preferably in the upper peripheral region 30 of the membrane collar 28. The encircling protrusion 36 also serves for positioning and/or aligning the fastening ring 32 between the bearing face 37 of the encircling protrusion 36 and the upper periphery 29 of the membrane collar 28.

The plane which orthogonally intersects the longitudinal central axis 33 in which the bearing face 37 of the encircling protrusion 36 is situated runs so as to be parallel to the encircling upper periphery 29 of the membrane collar 28 and thus also so as to be parallel to the upper opening 31 of the pressing membrane 19.

The encircling protrusion 36 constricts an interior space 38 of the pressing membrane 19 that is surrounded by the membrane collar 28 to the extent that said protrusion 36 forms a sufficiently large bearing face 37 for the lower side of the fastening ring 32 that is inserted from above into the membrane collar 28. The cross section of the encircling protrusion 38 is moreover formed such that the encircling protrusion 36 is sufficiently stable for supporting the fastening ring 32.

The encircling protrusion 36 is integrally molded to the internal side of the membrane collar 28, specifically preferably on the lower end of the upper peripheral region 30 of the membrane collar 28 are spaced apart from the periphery 29. On account thereof, the protrusion 36 is composed of the material of the pressing membrane 19 such that the protrusion 36 is also slightly flexible but by virtue of the dimensions thereof, in particular of the cross section thereof, is sufficiently stable so as to guarantee reliable supporting of the fastening ring 32 without there being any risk of the fastening ring 32 slipping past the encircling protrusion 36 into the interior space 38 of the pressing membrane 19.

An alternative exemplary embodiment of the pressing membrane 19 in which a plurality of preferably identical protrusions which are uniformly distributed on the internal circumference of the membrane collar 28 are provided instead of a single encircling protrusion 36 which protrudes into the interior space 38 of the pressing membrane 19 and/or constricts said interior space 38 is conceivable. Said plurality of protrusions can be positioned exactly like the encircling protrusion 36 and/or have an identical cross section as the encircling protrusion 36. In order for this plurality of smaller protrusions to be able to support the weight of the fastening ring 32, it is conceivable that these protrusions in terms of area have a larger cross section, in particular so as to be enlarged in the direction of the longitudinal central axis 33, and/or to have a larger height.

The fastening ring 32 is profiled on the external circumference thereof. To this end, said fastening ring 32 possesses a lower protrusion 39 having a preferably substantially rectangular cross section, and an upper protrusion 40 which is spaced apart from said law protrusion 39 and has a preferably wedge-shaped cross section. An outer periphery of the lower encircling protrusion 39 on the external side of the fastening ring 32 in the exemplary embodiment shown possesses a somewhat larger diameter than the external circumference of the upper protrusion 40. A lower delimitation face of the lower protrusion 39 as well as an upper delimitation face of the upper protrusion 40 run flush with the lower ring face 41, or with the upper ring face 42, respectively, of the fastening ring 32. The protrusion 39 and 40 thus contribute toward the enlargement of the ring faces 41 and 42 of the fastening ring 32.

An encircling groove 43 is situated between the lower protrusion 39 and the upper protrusion 40 on the external side of the fastening ring 32, said groove 43 at the top and the bottom thus being delimited by the protrusions 39 and 40.

The membrane collar 28 of the pressing membrane 19, proceeding from the upper periphery 29, possesses an inner encircling protrusion 44. Said protrusion 44 for forming a bearing for the fastening ring 32 is disposed above the protrusion 36 and spaced-apart therefrom, wherein this spacing is somewhat larger than the height of the lower protrusion 39 on the external side of the fastening ring 32 (FIG. 2). In terms of the cross section, the inward protrusion 44 that emanates from the upper periphery 39 of the membrane collar 28 is configured so as to correspond to the groove 43 in the external side of the fastening ring 32 wherein the cross section of the protrusion 44 on the internal side of the membrane collar 28 is preferably smaller than the groove 43 of the fastening ring 32. On account thereof, there is play between the fastening ring 32 and the membrane collar 28 when the fastening ring 32 is inserted into the pressing membrane 19 but not yet assembled below the ram plate 18.

In the exemplary embodiment shown, the encircling protrusion 44 in the upper region of the membrane collar 28 constricts the opening 31 of the latter to the extent that the encircling end of the protrusion 44 has a diameter which is somewhat smaller than the external diameter of the lower external protrusion 39 of the fastening ring 32. In the exemplary embodiment shown, the protrusion 44 constricts the interior space 38 of the membrane collar 29 approximately as much as protrusion 36 which for forming the bearing face 37 for the fastening ring 32 not yet assembled below the ram plate 18 is situated at a spacing below said protrusion 44 (FIG. 2). It is however also conceivable that the constriction of the internal diameter of the membrane collar 28 by the upper protrusion 44 is less than by the protrusion 36 for forming the bearing for the fastening ring 32. In this instance, the fastening ring 32 is more easily insertable into the membrane collar 28 with less expansion of the upper end region of said membrane collar 28.

An upper part of the external wall of the membrane collar 28 that points toward the periphery 29 tapers toward the periphery 29 at least in terms of the external diameter. This tapered part extends across at least half the height of the pressing membrane 19.

The ram plate 18 is provided with an encircling groove 45 which opens toward the lower side of said ram plate 18. This encircling groove 45 is situated in the external circumferential region of the ram plate 18 (FIG. 3) such that an external ring wall 46 of the groove 45 is somewhat spaced apart from the external circumferential face 47 of the ram plate 18. The ram plate 18 in this instance possesses an albeit only narrow ring wall for externally delimiting the groove 45. The groove 45 is furthermore delimited by an internal ring wall 48 and a circular wall for forming a groove base 49. The doughnut-type groove base 49 lies in a plane which is perpendicularly intersected by the longitudinal central axis 33 and runs so as to be parallel to the lower side and/or to the upper side of the ram plate 18. The internal ring wall 48 of the groove 45 runs so as to be perpendicular to the groove base 49 and parallel to the longitudinal central axis 33. The external ring wall 46 of the groove 45 runs so as to be slightly oblique such that said external ring wall 46 has a frustoconical shape that surrounds the longitudinal central axis 33 in concentric manner, wherein the inclination of the external ring wall 46 is directed in such a manner that the spacing of said external ring wall 46 from the cylindrical external circumferential face 47 of the ram plate 18 slightly increases toward the groove base 49 (FIG. 3).

The encircling groove 45 which in the lower side of the ram plate 18 is open at the bottom has a depth which corresponds to the height of the fastening ring 32 or, as in the exemplary embodiment shown, is slightly less than said height and alternatively may also be somewhat larger. In terms of the width, the groove 44 is dimensioned such that, in the case of a fastening ring 32 which is completely assembled below the ram plate 18 and tightly screw-fitted below the ram plate 18 with the screws 34, the fastening ring 32 as well as the major part of the upper peripheral region 30 of the membrane collar 28 fill the groove 44, and at least part of the peripheral region 30 of the membrane collar 28 is held so as to be tightly pressed under preloading in the groove 44. The inner upper protrusion 44 below the periphery 29 of the membrane collar 28 herein engages in the outer groove 43 of the fastening ring 32 and preferably completely fills the latter (FIG. 3). This results in the form-fitting connection between the pressing membrane 19 and the ram plate 18 by way of the fastening ring 32. Moreover, an additional force-fitting connection between the pressing membrane 19, the ram plate 18, and/or the fastening ring 32 can arise on account of at least part of the upper peripheral region 30 of the membrane collar 28 being compressed in the groove 45 (FIG. 3).

The method for assembling the afore-described pressing membrane 19 below the ram plate 18 proceeds as follows:

With the pressing basket 20 pivoted away, the pressing membrane 19 is positioned below the raised ram plate 18 specifically preferably such that the longitudinal central axis of the pressing membrane 19 lies on the longitudinal central axis 33 of the device. The fastening ring 32 is subsequently inserted and/or pushed in from above into the pressing membrane 19 through the opening 31, specifically so far that the fastening ring 32 is supported on the bearing face 37 of the protrusion 36, preferably at the lower end of the peripheral region 30 of the membrane collar 28. This can be performed manually or optionally with the aid of a lifting device.

The ram plate 18 is subsequently moved down by the hydraulic cylinder 14, specifically only so far that said ram plate is just shy of contacting the upper side of the fastening ring 32 but the screws 34 can already be initially screwed into the threaded bore 35 in the fastening ring 32 from the ram plate 18. However, before the screws 34 are screwed into the threaded bores 35 of the fastening ring 32, the fastening ring 32 and/or the pressing membrane 19 are positioned and aligned below the ram plate 18 such that the longitudinal central axes of the threaded bores 35 of the fastening ring 32 are in alignment with the longitudinal axes of the screws 34 which have been pushed through the ram plate 18, or that the longitudinal central axes of the through bores of the ram plate 18 are in alignment with the longitudinal central axes of the threaded bores 35 when the screws have not yet been inserted, respectively. This alignment is facilitated by the play between the upper peripheral region 30 of the membrane collar 28 and the fastening ring 32, in particular between the protrusion 39 and the groove 43, which is still present when the pressing membrane 19 has not yet been connected to the ram plate 18.

Once the screws 34 have been initially screwed into the fastening ring 32, the ram plate 18 is further moved down by the hydraulic cylinder 14, specifically so as to be close above the periphery 29 and/or the fastening ring 32, or until said ram plate 18 bears on the periphery 29 and/or the fastening ring 32. The upper periphery 29 of the membrane collar 28 then contacts the groove base 49 of the groove 45 in the lower side of the ram plate 18. The screws 34 thereafter are tightened to the extent that also the upper side of the fastening ring 32 bears on the groove base 49 and under preloading is pressed against the groove base 49 by the screws 34. In this tightening of the screws, at least a major part of the upper peripheral region 30 of the membrane collar 28 and/or the groove 44 of the membrane collar 28 are/is clamped between the ram plate 18, in particular the external frustoconical ring wall 46 of the groove 45 in the ram plate 18, and the fastening ring 32, on account of which an at least form-fitting, preferably also force-fitting, connection between the pressing membrane 19 and the fastening ring 32, the latter not being permanently connected to the pressing membrane 19 by adhesive bonding, vulcanizing, or in any other manner, is established.

After fastening the pressing membrane 19 below the ram plate 18 in the manner described above, the assembly procedure of the press ram 17 is completed. The press ram 17, conjointly with the pressing membrane 19 which by way of the fastening ring 32 is assembled below the ram plate 18, can now be raised by the hydraulic cylinder 14, and pivoting of the pressing basket 20 back to the operating position thereof shown in FIG. 1 can take place. The device, in particular the dewatering press, is then ready for operation.

Disassembling of a pressing membrane 19 that is worn or to be replaced, respectively, takes place in the reverse order. After disassembling the pressing membrane 19, the fastening ring 32 is pulled upward out of the latter, wherein the fastening ring 32 until being pulled out of the pressing membrane 19 again rests on the protrusion 36 at the lower end of the peripheral region 30 of the membrane collar 28. The fastening ring 32 originating from the pressing membrane 19 to be replaced can then be reused for a new pressing membrane 19 which is to be assembled below the ram plate 18.

Alternatively to the approach described above, it is also possible for the pressing basket 20 to be left in the operating position shown FIG. 1 in order for a pressing membrane 19 to be assembled below the ram plate 18. In this instance, the pressing membrane 19 to be freshly assembled is positioned on the pressing basket 20 with the ram plate 18 raised. In order to prevent the pressing membrane 19 from slipping into the pressing basket 20 herein, a board and/or beams is/are first placed on or across, respectively, the pressing basket 20, the pressing membrane 19 to be freshly assembled and, unless having occurred earlier, the fastening ring 32 being inserted from above until bearing on the protrusion 36, being supported on said board and/or beams.

LIST OF REFERENCE SIGNS

10 Laundry
11 Base plate
12 Press top bar
13 Column
14 Hydraulic cylinder
15 Cylinder body
16 Piston rod
17 Press ram
18 Ram plate
19 Pressing membrane
20 Pressing basket
21 Basket shell
22 Through bore
23 Loading chute
24 Hydraulic cylinder
25 Piston rod
26 Cylinder body
27 Membrane base
28 Membrane collar
29 Periphery
30 Peripheral region
31 Opening
32 Fastening ring
33 Longitudinal central axis
34 Screw
35 Threaded bore
36 Protrusion
37 Bearing face
38 Interior space
39 Protrusion
40 Protrusion
41 Lower ring face
42 Upper ring face
43 Groove
44 Protrusion
45 Groove
46 External ring wall
47 External circumferential face
48 Internal ring wall
49 Groove base

What is claimed is:

1. A pressing membrane (19) for a device for dewatering laundry (10), having a membrane base (27) and a membrane collar (28) which is molded on the membrane base (27) and has an encircling upper periphery (29) and a peripheral region (30) which for releasably fastening the membrane collar (28) by means of a fastening ring (32) below a ram plate (18) of a press ram (17) emanates from said upper periphery (29), said ram plate (18) being able to be moved up and down, wherein the membrane collar (28) on an internal side thereof has at least one protrusion (36) for forming an at least temporary bearing for the fastening ring (32) until connecting the pressing membrane (19) to the ram plate (18) wherein the at least one protrusion (36) of the membrane collar (28) forms an upper bearing face (37) for the fastening ring (32), wherein the respective bearing face (37) of the at least one protrusion (36) lies in a plane which orthogonally intersects the longitudinal central axis (33) of the pressing membrane (19) and the membrane collar (28) thereof.

2. The pressing membrane as claimed in claim 1, wherein the at least one protrusion (36) protrudes into an interior space (38) of the pressing membrane (19) that is surrounded by the membrane collar (28).

3. The pressing membrane as claimed in claim 2, wherein the at least one protrusion (36) in the direction toward a vertical longitudinal central axis (33) of the pressing membrane (19) protrudes radially into the interior space (38) of the pressing membrane (19) that is surrounded by the membrane collar (28).

4. The pressing membrane as claimed in claim 1, wherein the at least one protrusion (36) is disposed so far below the upper periphery (29) of the membrane collar (28) that the bearing face (37) of the respective protrusion (36) is situated at a spacing below the upper periphery (29) of the membrane collar (28), said spacing corresponding to at least the height of the fastening ring (32).

5. The pressing membrane as claimed in claim 1, wherein the at least one protrusion (36) is disposed in the region of a lower end of the upper peripheral region (30) of the membrane collar (28).

6. The pressing membrane as claimed in claim 1, wherein the at least one protrusion (36) delimits a lower end of the peripheral region (30) of the membrane collar (28).

7. The pressing membrane as claimed in claim 1, wherein the membrane collar (28) has a single inner encircling protrusion (36) having an annular bearing face (37).

8. The pressing membrane as claimed in claim 1, wherein the membrane collar (28) has a plurality of separate protrusions having in each case one bearing face, wherein all bearing faces (37) of said protrusions (36) lie in one common plane which orthogonally intersects the longitudinal central axis (33) of the membrane collar (28).

9. The pressing membrane as claimed in claim 1, wherein the membrane collar (28) toward the periphery (29) of the membrane collar (28) is configured so as to taper at least beyond the peripheral region (30).

10. The pressing membrane as claimed in claim 1, wherein an external side of the membrane collar (28) at least in the peripheral region (30) is configured so as to taper toward the periphery (29).

11. A device for dewatering laundry (10), having a press ram (17) which has a ram plate (18) and a flexible pressing membrane (19) that is releasably fastenable below said ram plate (18) by way of a fastening ring (32), said press ram (17) being able to be moved up and down, and the pressing membrane (19) having a membrane base (27) and a membrane collar (28) which is molded on the membrane base (27) and has an encircling upper periphery (29), wherein the membrane collar (28) on an internal side thereof has at least one protrusion (36) which is configured as a bearing for the fastening ring (32) at least until connecting said fastening ring (32) to the ram plate (18) wherein the at least one protrusion (36) forms a bearing for the fastening ring (32) at least until connecting the fastening ring (32) to a lower side of the ram plate (18).

12. The device as claimed in claim 11, wherein the bearing forms at least one bearing face (37) for the fastening ring (32).

13. The device as claimed in claim 12, wherein the fastening ring (32) on the external circumference thereof has a profiled structure, and an upper peripheral region (30) of the membrane collar (28) has an internal-side profiled structure between the upper periphery (29) and the bearing face (37) of the at least one protrusion (36), said internal-side profiled structure corresponding to the external-side profiled structure of the fastening ring (32).

14. The device as claimed in claim 12, wherein the fastening ring (32) is insertable from above into the membrane collar (28) up to the bearing face (37) of the at least one protrusion (36).

15. The device as claimed in claim 11, wherein an encircling groove (43) which is configured for receiving at least a major part of the fastening ring (32) and of the upper peripheral region (30) of the membrane collar (28) of the pressing membrane (19) that is assigned to said fastening ring (32) emanates from a lower side of the ram plate (18).

16. The device as claimed in claim 11, wherein the pressing membrane (19) has a membrane base (27) and a membrane collar (28) which is molded on the membrane base (27) and has an encircling upper periphery (29) and a peripheral region (30) which for releasably fastening the membrane collar (28) by means of the fastening ring (32) below the ram plate (18) of the press ram (17) emanates from said upper periphery (29), said ram plate (18) being able to be moved up and down, wherein the at least one protrusion (36) also forms an at least temporary bearing for the fastening ring (32) until connecting the pressing membrane (19) to the ram plate (18).

* * * * *